US006726514B2

(12) United States Patent
Nakajima et al.

(10) Patent No.: US 6,726,514 B2
(45) Date of Patent: Apr. 27, 2004

(54) PERSONAL WATERCRAFT

(75) Inventors: Jun Nakajima, Saitama (JP); Yoshiaki Noda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/283,255

(22) Filed: Oct. 30, 2002

(65) Prior Publication Data

US 2003/0134546 A1 Jul. 17, 2003

(30) Foreign Application Priority Data

Oct. 31, 2001 (JP) ..... 2001-335611

(51) Int. Cl.[7] ..... B63H 21/38
(52) U.S. Cl. ..... 440/88 A; 114/55.5
(58) Field of Search ..... 440/88 A; 114/55.5, 114/55.51, 55.53, 55.55

(56) References Cited

U.S. PATENT DOCUMENTS 5,906,524 A * 5/1999 Ozawa et al. ..... 440/2
5,957,072 A * 9/1999 Hattori ..... 114/55.57
6,027,384 A * 2/2000 Nitta et al. ..... 440/75
6,551,156 B2 * 4/2003 Nakamura et al. ..... 440/88 F

OTHER PUBLICATIONS

Patent Abstracts of Japan, JP–08–048287–A, Feb. 20, 1996, "Compact Planing Boat," Nitta Shigemitsu et al.

* cited by examiner

*Primary Examiner*—Jesus D. Sotelo
(74) *Attorney, Agent, or Firm*—Birch, Stewart, Kolasch & Birch, LLP

(57) ABSTRACT

A personal watercraft capable of preventing sea water or other water from remaining in intake system components. A personal watercraft is configured such that a saddle-type seat is disposed at approximately a central portion of a body. An engine is mounted under the seat with an axial line of the engine extending in the longitudinal direction of the body with cylinders provided in the engine extending along the longitudinal direction of the body. First to fourth intake pipes communicate with the cylinders and extend from a side surface of the engine. An air box for containing the first to fourth intake pipes is disposed in a space between the engine and a left side wall. The air box includes, at its portion in front of or behind the first to fourth intake pipes, a swelled portion swelled inwardly of the body in the width direction. An air suction port is formed in a lower portion of the swelled portion.

18 Claims, 12 Drawing Sheets

PERSONAL WATERCRAFT

CROSS-REFERENCE TO RELATED APPLICATIONS

The present nonprovisional application claims priority under 35 USC 119 to Japanese Patent Application No. 2001-335611 filed on Oct. 31, 2001 the entire contents thereof is hereby incorporated by reference.

BACKGROUND OF THE INVENTION

1. Field of the Invention

The present invention relates to a personal watercraft in which a saddle type seat is provided at approximately a central portion of a body, an engine is mounted under the seat with its axial line extending in the longitudinal direction of the body, and respective intake pipes communicate with a plurality of cylinders provided in the engine and extend from a side surface of the engine.

2. Description of Background Art

Personal watercrafts of this type have been known, for example, from Japanese Patent Laid-open No. Hei 8-48287 entitled "Personal Planing Watercraft." The personal watercraft will be hereinafter described in detail with reference to the FIG. 13 that corresponds to FIG. 1 of the above document. It is to be noted that parts of the personal watercraft in the following drawing are denoted by new reference numerals.

FIG. 13 is a sectional view of a related art personal watercraft. A personal watercraft 100 includes, at approximately a central portion of a deck 101, left and right side walls 102 and 103. A saddle-type seat 104 is provided on upper ends of the left and right side walls 102 and 103. An engine 105 is provided under the seat 104 with its axial line extending in the longitudinal direction of a body 106. Cylinders 105*a* . . . (symbol " . . . " indicates a plural number) in the engine 105 are tilted rightwardly, to largely expand a left side space 107 located on the left side of the engine 105. Intake system components 108 are provided in the left side space 107. With this configuration, the intake system components 108 can be prevented from protruding largely on the left side of a center 106*a* of the body 106.

By preventing the intake system components 108 from protruding largely on the left side of the center 106*a* of the body 106, a distance between the left and right side walls 102 and 103 on the deck 101 can be reduced in size. As a result, a driver can keep a natural posture when sitting astride the saddle-type seat 104 with his or her feet resting on foot-rest portions 101*a*.

The intake system components 108 are mainly composed of air funnels 108*a* . . . , an intake silencer 108*b*, and an intake pipe 108*c*. The intake silencer 108*b* is in communication with the cylinders 105*a* . . . via the air funnels 108*a* . . . , and the intake pipe 108*c* is in communication with the intake silencer 108*b*.

According to the intake system components 108, air sucked in the intake pipe 108*c* via an air suction port 108*d* of the intake pipe 108*c* is directed to the intake silencer 108*b*, and the air led in the intake silencer 108*b* is introduced into the cylinders 105*a* . . . via the air funnels 108*a* . . .

According to this configuration of the related art personal watercraft, however, the intake pipe 108*c* extends rearwardly from a rear wall of the intake silencer 108*b* and also extends in the horizontal direction toward the center 106*a* of the body 106. A connection lower end 108*e*, at which the intake pipe 108*c* is connected to the rear wall of the intake silencer 108*b* is positioned over a bottom surface 108*f* of the intake silencer 108*b*.

Accordingly, if sea water or other water penetrates into the intake silencer 108*b*, the water possibly remains in the intake system components 108, particularly, in the intake silencer 108*b*.

SUMMARY AND OBJECTS OF THE INVENTION

An object of the present invention is to provide a personal watercraft capable of preventing sea water or other water from remaining in intake system components.

To solve the above-described problem, according to the present invention, there is provided a personal watercraft, in which a saddle-type seat is disposed at approximately a central portion of a body. An engine is mounted under the seat with an axial line of a crankshaft of the engine extending in the longitudinal direction of the body. A plurality of cylinders are provided in the engine that extend along the longitudinal direction of the body with respective intake pipes communicating with the cylinders extending from a side surface of the engine. An air box for containing the intake pipes is disposed in a space between the engine and a side wall. The personal watercraft includes the air box having at its portion in front of or behind the intake pipes, a swelled portion swelled inwardly of the body in the width direction; and an air suction port is formed in a lower portion of the swelled portion.

The air suction port is formed in the lower portion of the swelled portion of the air box. Accordingly, if sea water or other water penetrates into the air box, the water can be directed to the air suction port and be discharged outwardly from the air suction port. As a result, it is possible to prevent sea water or other water from remaining in the air box.

The air box has, at its portion in front of or behind the intake pipes, the swelled portion. In other words, the swelled portion can be disposed in front of or behind the engine. Accordingly, even if the swelled portion is swelled inwardly of the body in the width direction, it does not interfere with the engine. As a result, an outer side surface of the swelled portion can be made as close to the center side of the body as possible, so that the distance between the left and right side walls extending downwardly from the seat can be reduced in size.

According to the present invention, a bottom surface of the air box is tilted at a descending gradient toward the air suction port.

Since the bottom surface of the air box is tilted at a descending gradient toward the air suction port, if sea water or other water penetrates into the air box, the water can be efficiently directed along the descending gradient towards the air suction port and can be discharged from the air suction port. As a result, it is possible to prevent sea water or other water from remaining in the air box.

According to the present invention, an intake trap is disposed in the swelled portion at a position between the intake pipes and the air suction port.

Since the intake trap is provided between the intake pipes and the air suction port, even if dust is contained in air sucked from the air suction port, the dust can be removed by the intake trap. As a result, it is possible to supply clean air having been filtered by the intake trap via the intake pipes to the cylinders.

If a flame flows into the swelled portion side by a phenomenon such as back fire, the flow of the flame can be blocked by the intake trap.

According to the present invention, a breather pipe is mounted on the swelled portion via a breather trap.

Since the breather pipe is provided in the swelled portion via the breather trap, if a flame flows into the swelled portion side by a phenomenon such as back fire, the flow of the flame can be blocked by the breather trap.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
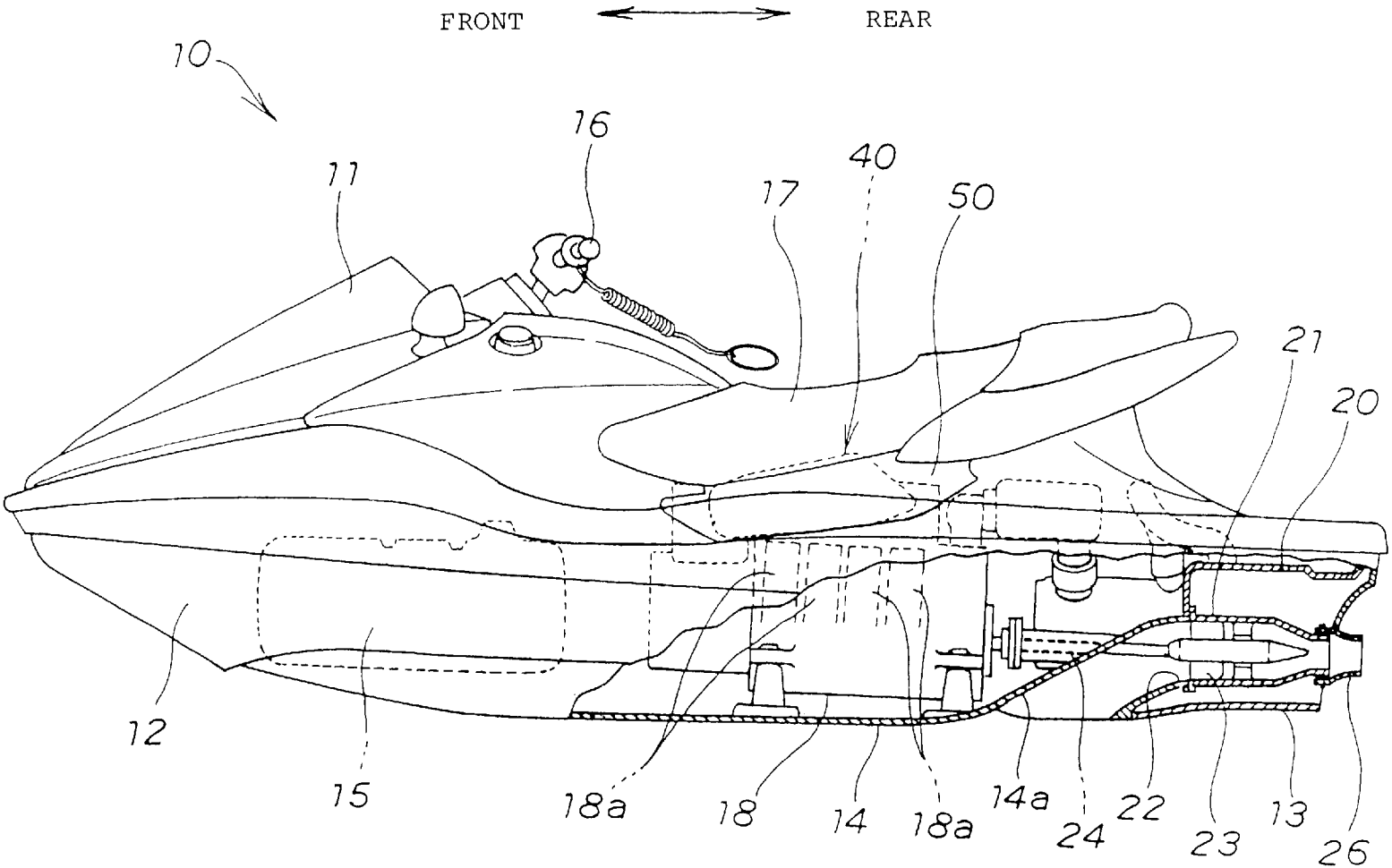
FIG. 1 is a side view of a personal watercraft according to the present invention.

An embodiment of the present invention will be hereinafter described with reference to the accompanying drawings wherein FIG. 1 is a side view of a personal watercraft according to the present invention.

A personal watercraft 10 is a jet propulsion watercraft with its main components disposed as described below. A fuel tank 15 is mounted to a front portion 12 of a body 11 and a steering handlebar 16 is disposed over the fuel tank 15. A saddle type seat 17 is disposed behind the steering handlebar 16 and an engine 18 is disposed under the seat 17. A jet propulsion chamber 20 is disposed at a stern 13 located behind the engine 18 and a jet propulsion unit 21 is disposed in the jet propulsion chamber 20.

The jet propulsion unit 21 has a housing 22 extending rearwardly from an inlet 14*a* of a bottom 14 of the body 11. An impeller 23 is rotatably mounted in the housing 22 and is coupled with a drive shaft 24 of the engine 18.

When the impeller 23 is rotated by the engine 18, water is sucked from the inlet 14*a* of the bottom 14 and is directed as a water jet in a steering nozzle 26 via the housing 22. The water jet thus directed by the steering nozzle 26 is jetted from the steering nozzle 26, to propel the personal watercraft 10.

Figure 2:
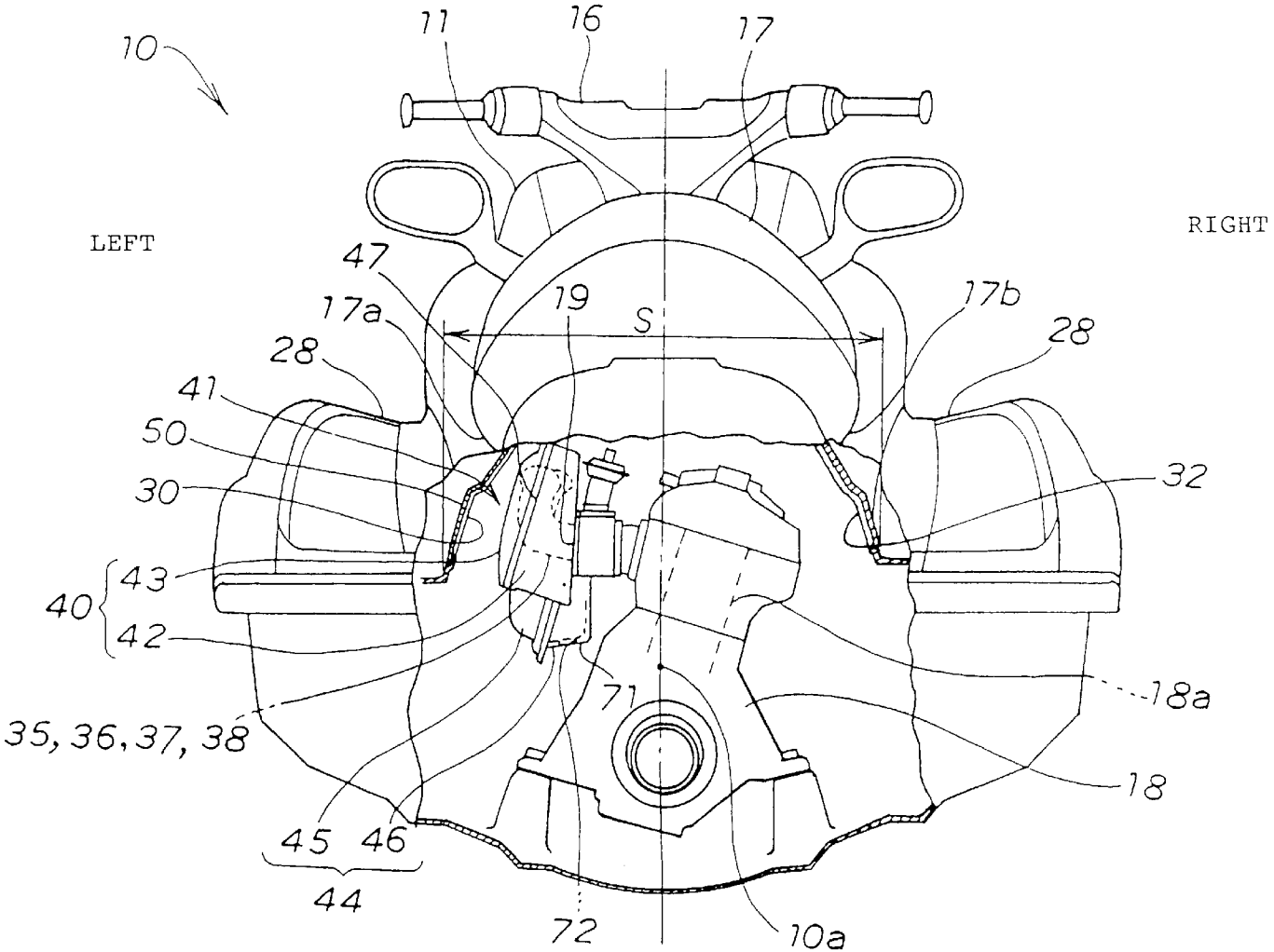
FIG. 2 is a back view showing an essential portion of the personal watercraft according to the present invention.

FIG. 2 is a back view showing an essential portion of the personal watercraft according to the present invention.

The personal watercraft 10 includes the saddle type seat 17 at approximately a central portion of the body 11. Left and right cover-like side walls 30 and 32 extend downwardly from left and right lower edges 17*a* and 17*b* of the seat 17, respectively. The engine 18 is mounted under the seat 17 with an axial line of a crankshaft extending in the longitudinal direction of the body 11. (See FIG. 1 also.) A plurality of cylinders 18*a* . . . (see FIG. 1 also) provided in the engine 18 are arranged along the longitudinal direction, and intake pipes (that is, air funnels) 35, 36, 37 and 38 communicating with the cylinders 18*a* . . . extend from a side surface 19 of the engine 18. An air box 40, which contains the intake pipes 35 to 38, is disposed in a space 41 between the engine 18 and the left side wall (side wall) 30.

The space 41 between the engine 18 and the left side wall 30 can be increased in size by tilting the engine 18 on the right side of the body 11. Accordingly, by providing the intake pipes 35 to 38 and the air box 40 in the space 41, the intake pipes 35 to 38 and the air box 40 can be prevented from protruding largely on the left side of a center 10*a* of the body 11.

A distance S between the left and right side walls 30 and 32 can be thus set to a small value. The reduced distance S is advantageous in that when a driver sits astride the saddle type seat 17 with his or her feet resting on foot-rest portions 28 provided on a deck, he or her can maintain a natural drive posture.

The air box 40 includes a box main body 42 mounted to the engine 18, a lid body 43 removably mounted to the box main body 42, and a swelled portion 44 provided on a front portion of the box main body 42. The air box 40 is disposed with the lid body 43 opposed to the left side wall 30 of the body 11.

The swelled portion 44 includes a supporting frame 45 formed integrally with the front portion of the box main body 42, and a swelled cover 46 removably mounted to the supporting frame 45.

In addition, a mounting face 47, to which the lid body 43 is to be mounted, of the box main body 42 is formed in such a manner so as to be substantially in parallel to the left side wall 30.

Figure 3:
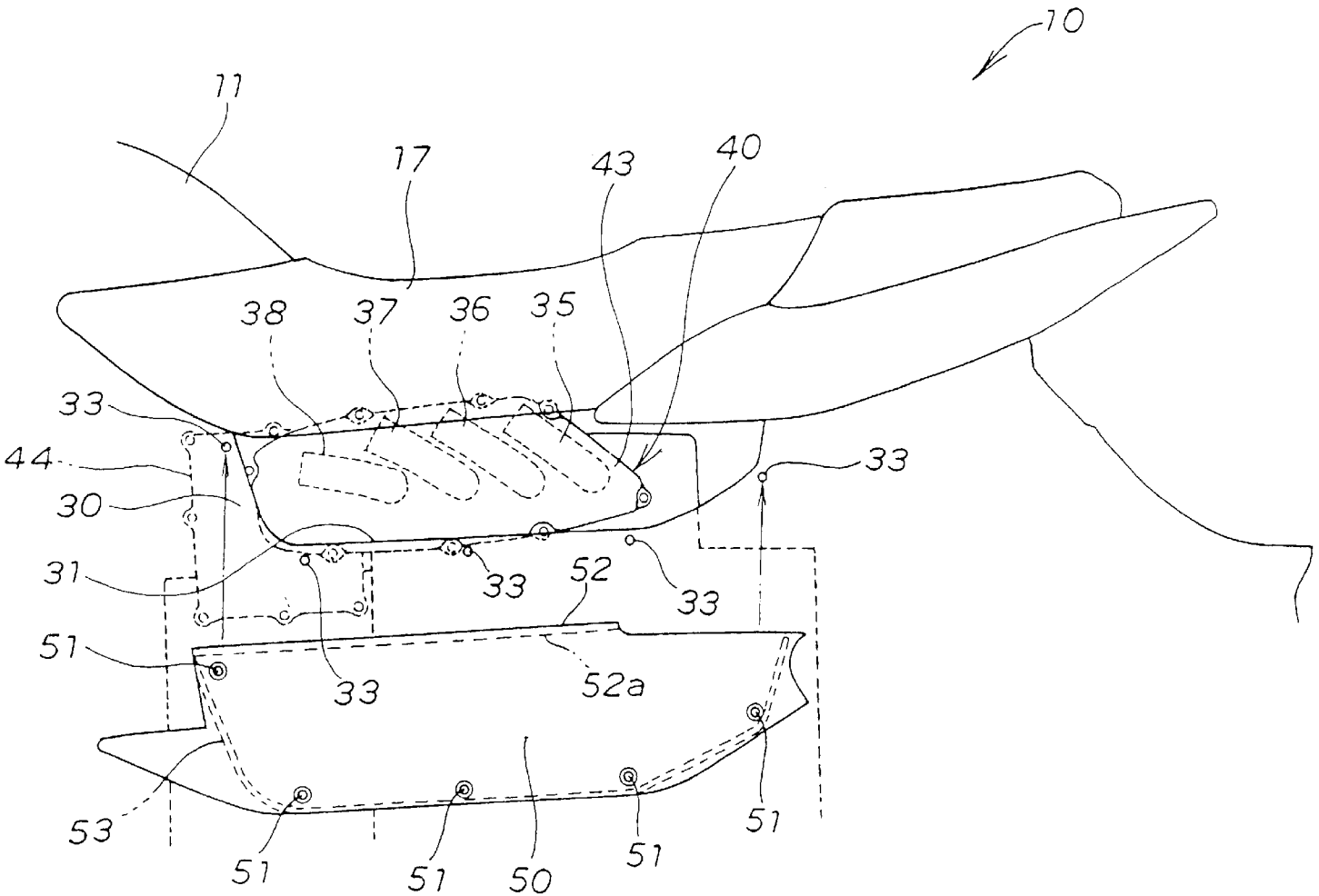
FIG. 3 is a side view showing an essential portion of the personal watercraft according to the present invention.

FIG. 3 is a side view showing an essential portion of the personal watercraft according to the present invention, showing a state wherein an opening 31 is formed in a portion, opposed to the lid body 43, of the left side wall (that is, the side wall under the seat) 30, and a side cover 50 is removably mounted to the opening 31.

The side cover 50 can be mounted to the left side wall 30 to close the opening 31 by inserting bolts (not shown) in insertion holes 51 . . . formed in a peripheral edge portion of the side cover 50 and screwing the bolts in mounting holes 33 . . . on the left side wall 30.

The opening 31 formed in the left side wall 30 can be opened by loosening the bolts, removing the bolts from the mounting holes 33 . . . , and removing the side cover 50 from the left side wall 30.

Since the lid body 43 of the air box 40 is disposed opposite to the left side wall 30, the opening 31 is formed in the left side wall 30, and the side cover 50 is removably mounted to the opening 31, the lid body 43 can be simply removed from the box main body 42 by removing the side cover 50 from the left side wall 30, to open the opening 31, and removing the lid body 43 by making use of the opening 31.

By the way, for the personal watercraft 10, the width of the air box 40 must be made narrow for allowing a driver to easily sit astride the saddle-type seat 17. However, the side surface of the air box 40 can be made relatively large. Accordingly, since the lid body 43 is disposed on the side surface of the air box 40, the shape of the lid body 43 can be increased.

According to this embodiment, since the lid body 43 can be simply removed and a large opening can be formed in front of the box main body 42 by removing the lid body 43, it is possible to simply perform maintenance and inspection of the inside of the box main body 42.

Figure 4:
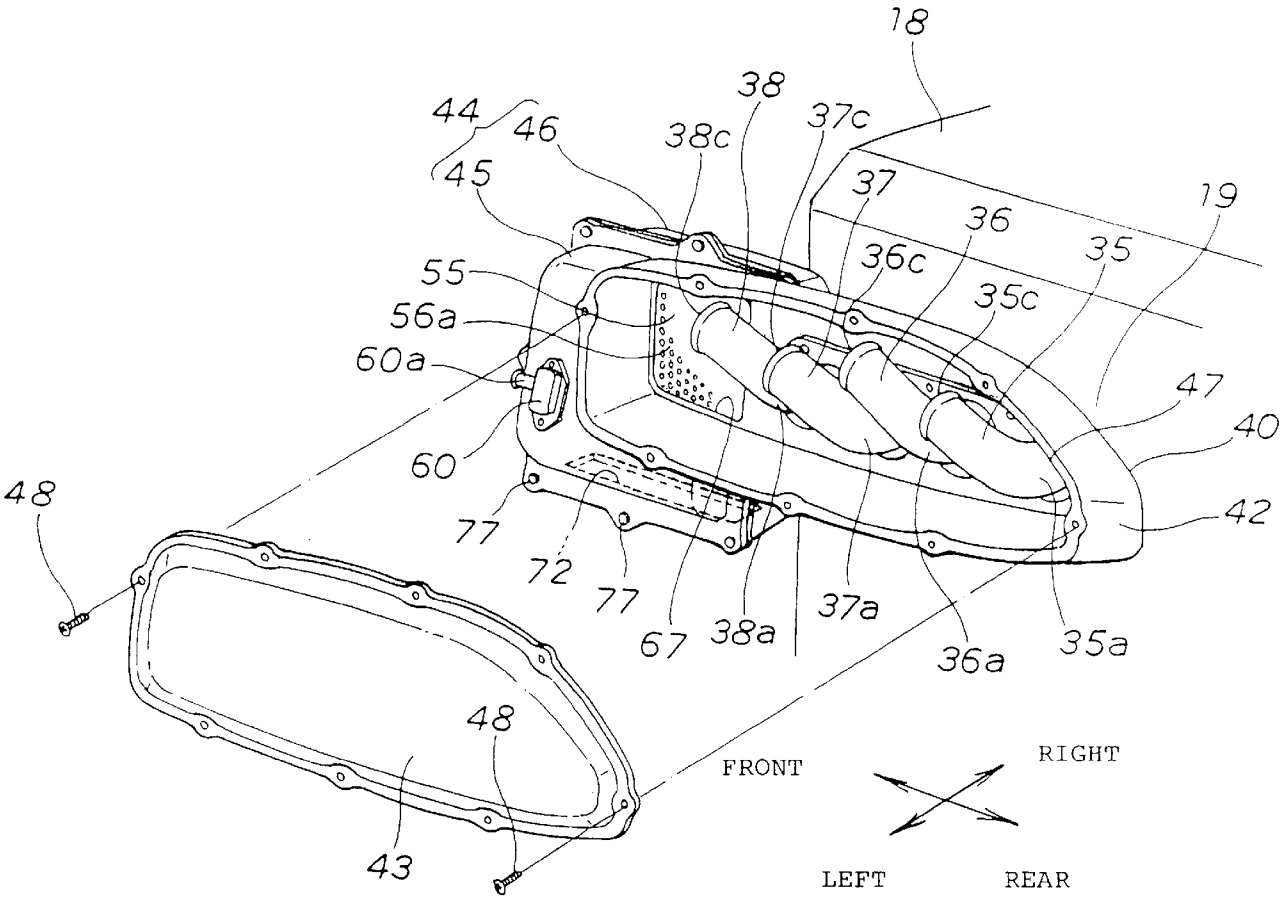
FIG. 4 is a perspective view showing an essential portion of the personal watercraft according to the present invention.

FIG. 4 is a perspective view showing an essential portion of the personal watercraft according to the present invention. As shown in FIG. 4, four of the cylinders 18*a* . . . provided in the engine 18 are arranged along the longitudinal direction of the body 11 (see FIG. 1) and the intake pipes 35 to 38 in communication with the cylinders 18*a* . . . extend from a side surface 19 of the engine 18. The intake pipes 35 to 38 are contained in the box main body 42 of the air box 40. The lid body 43 is depicted as being removed from the mounting face 47 of the box main body 42.

It is to be noted that the intake pipes 35 to 38 are hereinafter referred as first, second, third, and fourth intake pipes 35, 36, 37 and 38 arranged in the direction from the rear side to the front side of the body 11, respectively.

The lid body 43 can be mounted to the box main body 42 by bringing the lid body 43 into contact with the mounting face 47 of the box main body 42 and fastening the lid body 43 to the box main body 42 with bolts 48 . . . .

Since the first to fourth intake pipes 35, 36, 37 and 38 disposed in the box main body 42 can be covered with the lid body 43 mounted to the box main body 42, it is possible to prevent sea water or other water from being splashed on the first to fourth intake pipes 35 to 38.

To extend the intake pipes 35 to 38 forwardly at ascending gradients, the first to fourth intake pipes 35 to 38 are bent in the vicinities of base portions 35*a* to 38*a* thereof, respectively. This is advantageous in that the lengths of the first to fourth intake pipes 35 to 38 can be made long without preventing the first to fourth intake pipes 35 to 38 from protruding significantly on the left side of the center 10*a* of the body 10. (See FIG. 1.)

Figure 5:
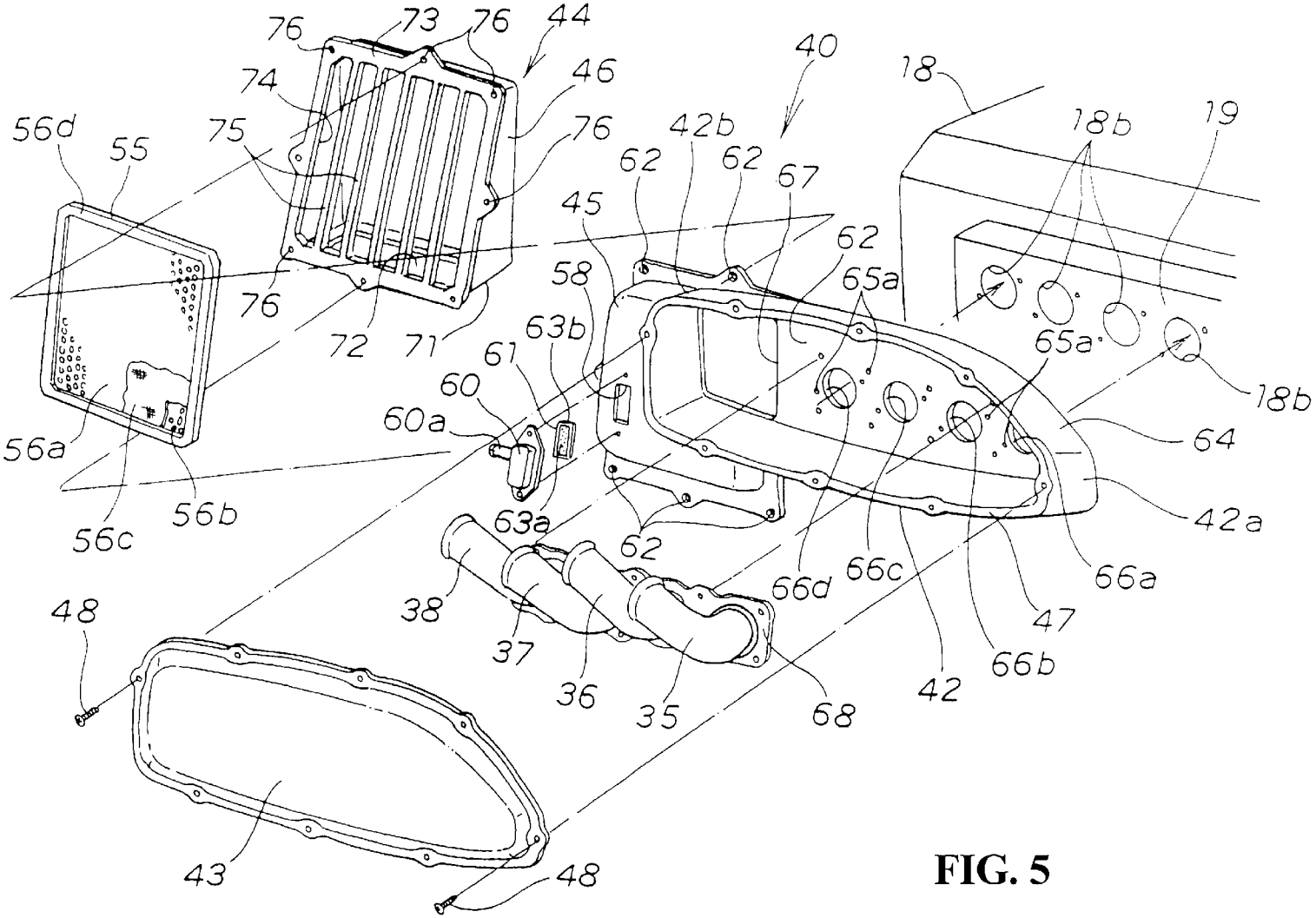
FIG. 5 is an exploded perspective view showing an essential portion of the personal watercraft according to the present invention.

FIG. 5 is an exploded perspective view showing an essential portion of the personal watercraft according to the present invention.

The air box 40 includes the box main body 42 mountable to the side surface 19 of the engine 18 and capable of containing the first to fourth intake pipes 35 to 38; the lid body 43 removably mounted to the mounting face 47 of the box main body 42; the supporting frame 45 formed integrally with a front end portion of the box main body 42; the swelled cover 46 removably mounted to the supporting frame 45; an intake trap 55 held between the supporting frame 45 and the swelled cover 46; and a breather 60 mounted to a breather opening 58 formed in the supporting frame 45.

As described above, the supporting frame 45 and the swelled cover 46 constitute the swelled portion 44.

The box main body 42 has an outer peripheral wall 64 formed into approximately a rectangular shape, wherein an inner end face, on the engine 18 side, of the outer peripheral wall 64 is blocked with an inner wall 65 and an outer end face (that is, mounting face) 47, on the left side wall 30 side (see FIG. 2), of the outer peripheral wall 64 is left as being opened. Four insertion holes 66*a* to 66*d* and a rectangular air inlet 67 are formed in the inner wall 65. The first to fourth insertion holes 66*a* to 66*d* are arranged in this order in the direction from a rear end 42*a* of the box main body 42 to the front side, and the air inlet 67 is located in front of the fourth insertion hole 66*d*.

The supporting frame 45 protrudes forwardly from a front end portion 42*b* of the box main body 42. The supporting frame 45 has the breather opening 58 at a position near the box main body 42. The breather 60 and a breather trap 61 are mounted in the breather opening 58. The supporting frame 45 also has, in its peripheral portion, mounting holes 62 . . . for mounting the swelled cover 46.

The box main body 42 is assembled as follows: namely, bolts (not shown) are inserted in mounting holes 65*a* . . . formed in the inner wall 65 to mount the box main body 42 to the side surface 19 of the engine 18 with the bolts, and the base ends 35*a* to 38*a* of the first to fourth intake pipes 35 to 38 are inserted in the first to fourth insertion holes 66*a* to 66*d* of the inner wall 65 and are also inserted in intake ports 18*b* . . . of the engine 18. In such a state, the first to fourth intake pipes 35 to 38 are mounted to the inner wall 65 by means of a fixing member 68.

Flanges 35*b* to 38*b* (see FIG. 6) are formed on the base ends 35*a* to 38*a* of the first to fourth intake pipes 35 to 38, respectively, and these flanges 35*b* to 38*b* are pressed by the fixing member 68, to fix the first to fourth intake pipes 35 to 38.

Since the fixing member 68 is provided separately from the first to fourth intake pipes 35 to 38, the shapes of the first to fourth intake pipes 35 to 38 can be simplified. As a result, the first to fourth intake pipes 35 to 38 can be simply produced by a blow molding process, to thereby reduce the production cost of the first to fourth intake pipes 35 to 38.

In general, an ordinary intake pipe has a fixing member integrated with a base end of the intake pipe, so that the shape of the intake pipe becomes complicated, to cause a difficulty in producing the intake pipe by a blow molding process. This makes it difficult to reduce the production cost of the ordinary intake pipe.

It is to be noted that the molding process of forming the first to fourth intake pipes 35 to 38 is not limited to that described above but may be another molding process such as an injection molding process.

The intake trap 55 is held by the swelled cover 46, and in such a state, the swelled cover 46 is mounted to the supporting frame 45. (See FIG. 4.) The swelled cover 46 is formed into approximately a triangular shape in a side view by swelling a lower portion 71 inwardly of the body 11. (See FIG. 12.) An air suction port 72 is formed in the lower portion 71. A louver 75 for supporting the intake trap 55 is mounted to an opening portion 74 of a mounting face 73 of the swelled portion 46. An outer periphery portion of the swelled portion 46 has mounting holes 76 . . . corresponding to the mounting holes 62 . . . formed in the supporting frame 45.

The intake trap 55 is exemplified by a rectangular member configured such that two punching metal portions 56*a* and 56*b* and a wire netting portion 56*c* held therebetween (see FIG. 6 also) are integrally mounted in a frame body 56*d*.

The swelled cover 46 can thus be mounted on the supported frame 45 by inserting bolts 77 . . . (see FIG. 4) in the mounting holes 62 . . . of the supporting frame 45 and in the mounting holes 76 . . . of the swelled cover 46 in the state wherein the intake trap 55 is held between the supporting frame 45 and the swelled cover 46. (See FIG. 6 also.)

Like the intake trap 55, the breather trap 61 is configured such that rectangular punching metal portions 63*a* (only one on the front side is shown) and a wire netting portion (not shown) held therebetween are integrally mounted in a frame body 63*b*.

The breather 60 is mounted, together with the breather trap 61, to the supporting frame 45 of the swelled portion 44 in such a manner that the breather trap 61 is located between the breather 60 and the supporting frame 45. After the breather 60 is mounted to the supporting frame 45 of the swelled portion 44 via the breather trap 60, a breather hose (not shown) extending from a cylinder head cover of the engine is connected to a pipe 60*a* of the breather 60.

Referring again to FIG. 4, air is sucked in the swelled portion 44 via the air suction port 72 formed in the lower portion 71 of the swelled portion 46, and is then directed into the box main body 42 from the air inlet 67 via the intake trap 55. The air thus directed into the box main body 42 is directed into the first to fourth intake pipes 35 to 38 via inlets 35*c* to 38*c* thereof, and is then introduced from the first to fourth intake pipes 35 to 38 into the corresponding cylinders 18*a* . . . . (See FIG. 1.)

In this case, since the intake trap 55 is provided in the swelled portion 44, dust contained in air can be removed by the intake trap 55.

On the other hand, if a flame flows in the swelled cover 46 side by a phenomenon such as back fire, the flow of the flame can be blocked by the intake trap 55 or the breather trap 61. (See FIG. 5.)

Referring again to FIG. 2, since the swelled cover 46 is swelled inwardly of the body 11 and the air suction port 72 is formed in the lower portion 71 thereof, the air suction port 72 can be disposed as close to the center of the body 11 as possible. As a result, the air suction port 72 can be directed to the engine 18 side, that is, can be prevented from projecting outwardly of the body 11.

Accordingly, if the personal watercraft 10 is turned over and is then recovered from the turn-over state to the normal state, the resistance of the air suction port 72 against the recovering motion in sea water can be made as small as possible. As a result, the personal watercraft 10 can be simply recovered from the turn-over state to the normal state.

Figure 6:
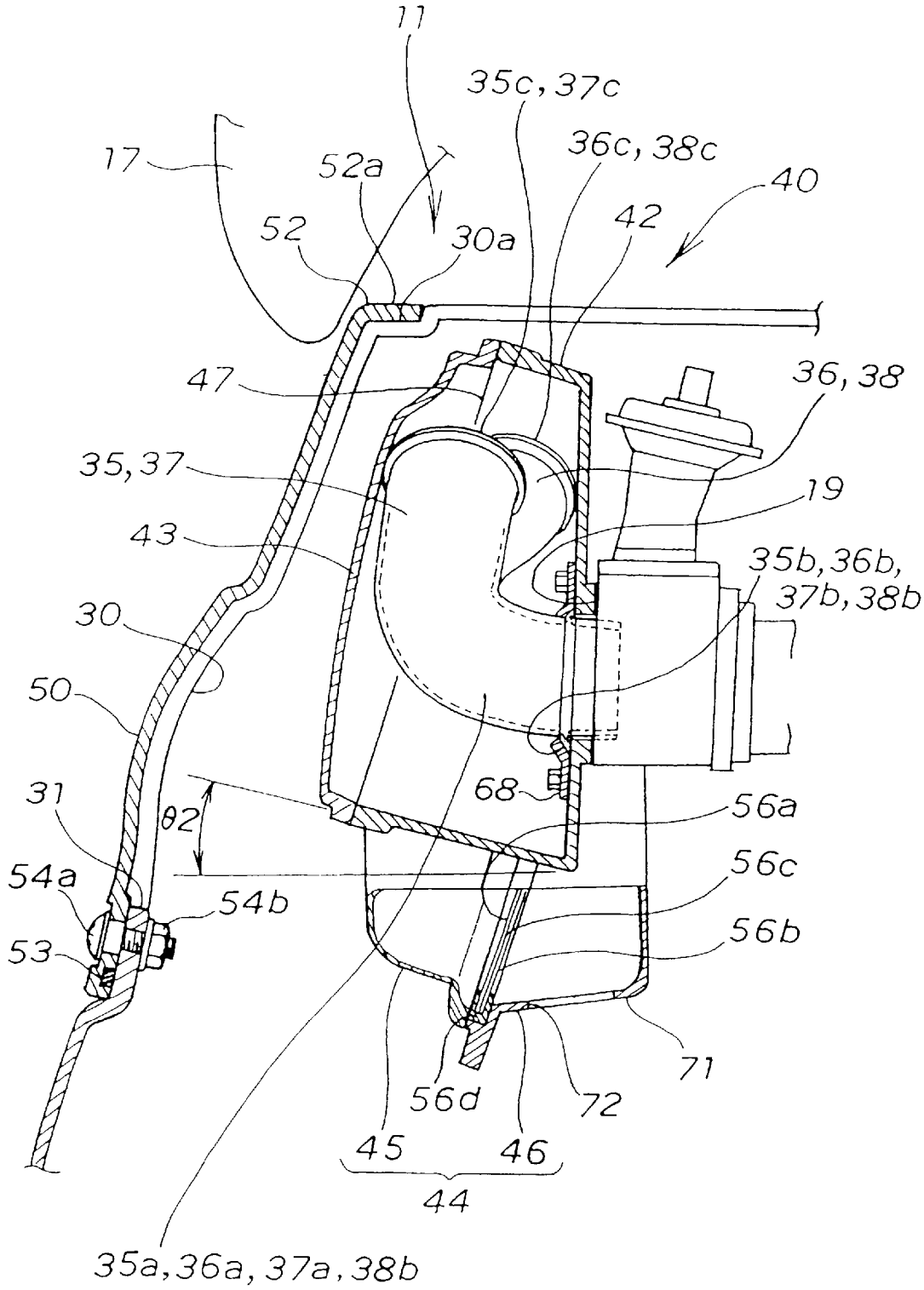
FIG. 6 is a sectional view showing an essential portion of the personal watercraft according to the present invention.

FIG. 6 is a sectional view showing an essential portion of the personal watercraft according to the present invention. As shown in FIG. 6, the first to fourth intake pipes 35 to 38, are bent at the base ends 35*a* to 38*a* and extend upwardly at an ascending gradient along the left side wall 30 under the seat 17. The lid body 43 is disposed opposite to the left side wall 30, and the opening 31 is formed in a portion, opposed to the lid body 43, of the left side wall 30. The side cover 50 is removably mounted to the opening 31. The mounting face 47, to which the lid body 43 is to be mounted, of the box main body 42 is formed so as to be substantially in parallel to the left side wall 30. The supporting frame 45 is formed integrally with the front portion (that is, the fourth intake pipe 38 side) of the box main body 42, and the swelled cover 46 is mounted on the supporting frame 45 in such a manner so as to be swelled inwardly of the body 11 in the width direction. The air suction port 72 is formed in the lower portion 71 of the swelled cover 46.

Since the first to fourth intake pipes 35 to 38 are bent at the base ends 35*a* to 38*a* and extend at an ascending gradient along the left side wall 30 under the seat 17, the inlets 35*c* to 38*c* of the first to fourth intake pipes 35 to 38 can be located at positions higher than those of the base ends 35*a* to 38*a*.

Accordingly, if sea water or other water penetrates in the body 11, it becomes difficult for the water to reach the inlets 35*c* to 38*c* of the first to fourth intake pipes 35 to 38. As a result, it is possible to prevent sea water or other water from penetrating in the first to fourth intake pipes 35 to 38 via the inlets 35*c* to 38*c* thereof As shown in FIG. 3, a seal material 53 is mounted to a peripheral edge, excluding an upper end 52, of the side cover 50. The seal material 53 is overlapped to the left side wall 30 and a front end of a bent portion 52*a* of the upper end 52 is placed on a stepped portion 30*a* of the left side wall 30. In such a state, the side cover 50 is fixed to the left side wall 30 with bolts 54*a* . . . and nuts 54*b* . . .

The opening 31 is uncovered by removing the side cover 50 from the left side wall 30, and the lid body 43 can be simply removed from the box main body 42 by making use of the uncovered opening 31.

Since the flanges 35*b* to 38*b* are formed on the base ends 35*a* to 38*a* of the first to fourth intake pipes 35 to 38 (see FIG. 7 also), the first to fourth intake pipes 35 to 38 can be fixed by pressing the flanges 35*b* to 38*b* by means of the fixing member 68.

Figure 7:
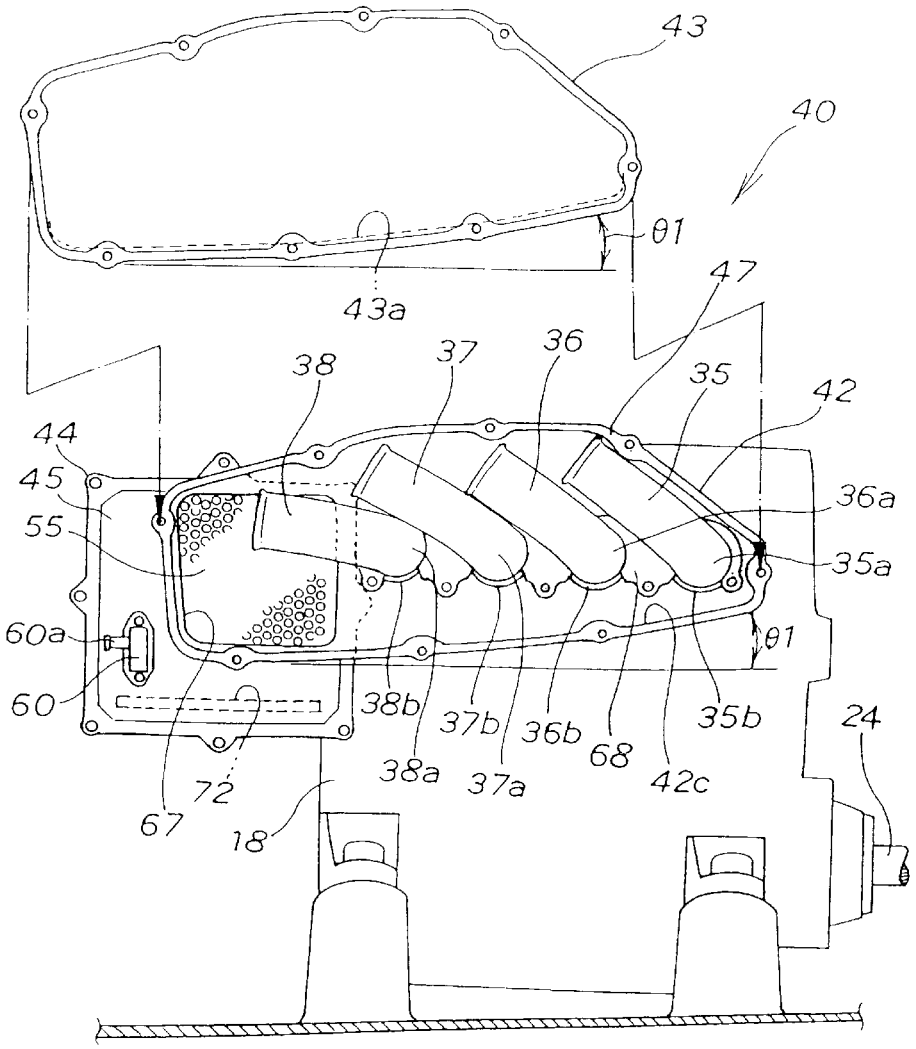
FIG. 7 is a side view showing an essential portion of the personal watercraft according to the present invention.

FIG. 7 is a side view showing an essential portion of the personal watercraft according to the present invention, showing a state wherein the lid body 43 is removed from the box main body 42.

The air box 40 is configured such that a bottom surface 42*c* of the box main body 42 and a bottom surface 43*a* of the lid body 43 are each tilted at a descending gradient of a tilt angle $\theta 1$ toward the air inlet 67.

Since the bottom surface 42*c* of the box main body 42 and the bottom surface 43*a* of the lid body 43 are each tilted at the descending gradient of the tilt angle $\theta 1$ toward the air inlet 67, even if sea water or other water penetrates in the air box 40, the water can be efficiently directed to the air inlet 67 along the bottom surface 42*c* of the box main body 42 and the bottom surface 43*a* of the lid body 43 and is made to flow in the swelled portion 44 through the air inlet 67.

Since the air suction port 72 is formed in the lower portion 71 of the swelled portion 44, the water flowing into the swelled portion 44 can be certainly discharged outwardly from the swelled portion 44 through the air suction port 72. As a result, it is possible to prevent sea water or other water from remaining in the air box 40 or the swelled portion 44.

The bottom surface 42*c* of the box main body 42 and the bottom surface 43*a* of the lid body 43 are, as shown in FIG. 6, each also tilted at a descending gradient of a tilt angle $\theta 2$ towards the center of the body 11, that is, toward the air inlet 67. With this configuration, sea water or other water in the air box 40 can be more efficiently directed to the air inlet 67, to flow in the swelled portion 44, and the water flowing into the swelled portion 44 can be more certainly discharged outwardly from the swelled portion 44 through the air suction port 72.

Since the first to fourth intake pipes 35 to 38 are bent at the base ends 35*a* to 38*a* and extend along the left side wall 30 under the seat 17 as described with reference to FIG. 6, the first to fourth intake pipes 35 to 38 can be made to extend longer upwardly without protruding outwardly from the left side wall 30 under the seat 17. (See FIG. 6.)

As a result, the distance S (see FIG. 2) between the left and right side walls 30 and 32 under the seat 17 can be reduced in size, to allow a driver to sit astride the saddle-type seat 17 with a natural posture.

Figure 8:
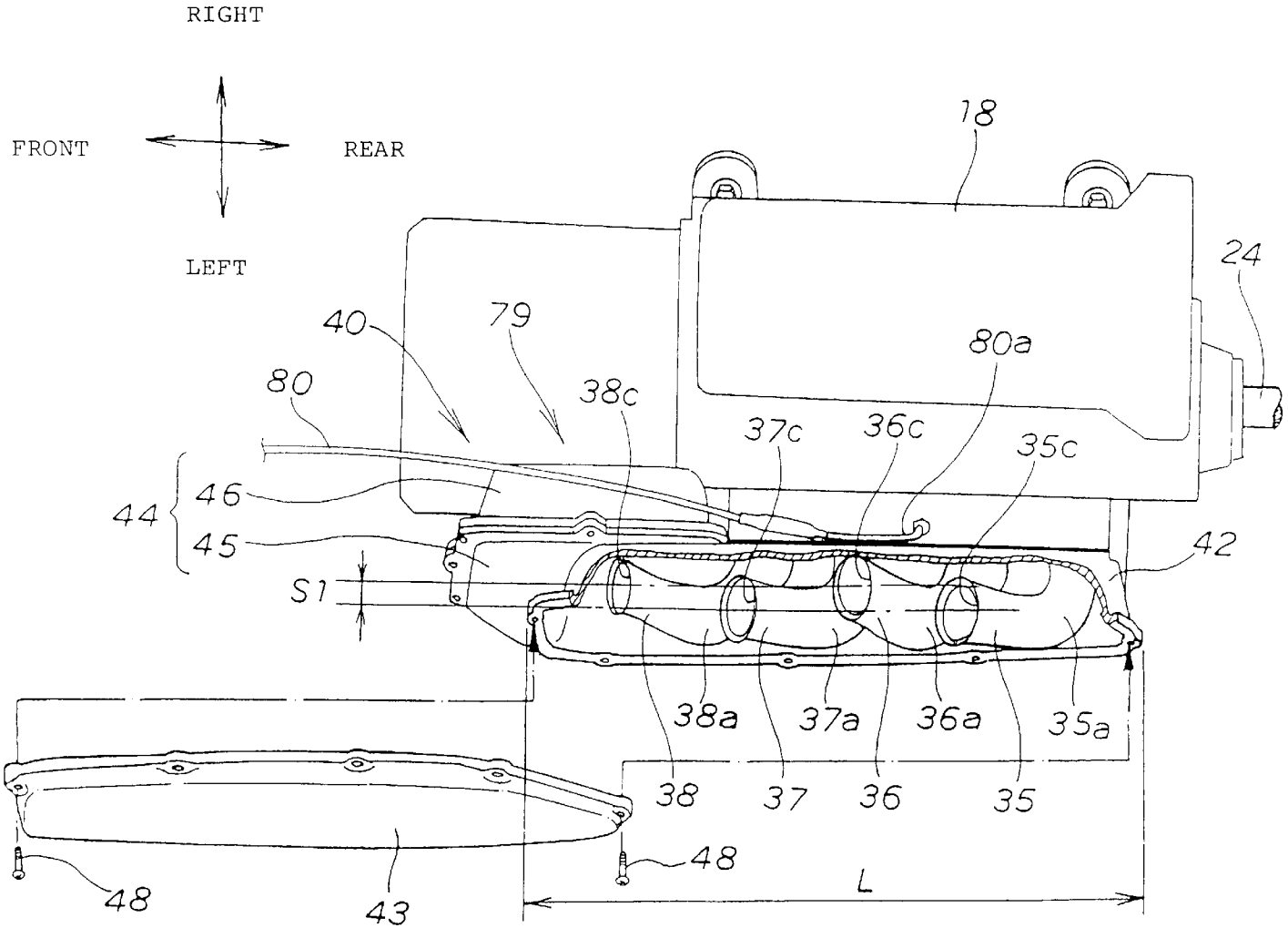
FIG. 8 is a plan view showing an essential portion of the personal watercraft according to the present invention.

FIG. 8 is a plan view showing an essential portion of the personal watercraft according to the present invention, showing a state that the lid body 43 is removed from the box main body 42.

The first to fourth intake pipes 35 to 38 are bent such that the inlets 35*c* to 38*c* thereof are arranged in a staggered pattern. To be more specific, the first and third intake pipes 35 and 37 are bent at the base ends 35*a* and 37*a* into the same curve with a shelving angle, and the second and fourth intake pipes 36 and 38 are bent at the base ends 36*a* and 38*a* into the same curve with a relatively sharp angle.

Since the first and third intake pipes 35 and 37 are bent into the same curve with a shelving angle and the second and fourth intake pipes 36 and 38 are bent into the same curve with a relatively sharp angle, the inlets 35*c* and 37*c* of the first and third intake pipes 35 and 37 can be located at positions apart from the center 10*a* (see FIG. 2) of the personal watercraft 10, and the inlets 36*c* and 38*c* of the second and fourth intake pipes 36 and 38 can be located at positions close to the center 10*a* of the personal watercraft 10, that is, located so as to be offset inwardly of the personal watercraft 10 from the inlets 35*c* and 37*c* by a distance S1.

The inlets 35*c* to 38*c* of the first to fourth intake pipes 35 to 38 can be thus densely arranged in a staggered pattern.

This is effective to make the box main body 42 containing the first to fourth intake pipes 35 to 38 compact, that is, to shorten a length L of the box main body 42. Accordingly, even if the first to fourth intake pipes 35 to 38 are made to extend longer in the upward direction, the air box 40 can be disposed in such a manner so as to be close to the center of the body 11.

As a result, the distance S (see FIG. 2) between the left and right side walls 30 and 32 under the seat 17 can be reduced in size, to allow a driver to sit astride the seat 17 with a natural posture.

On the contrary, if the inlets 35*c* to 38*c* of the first to fourth intake pipes 35 to 38 are disposed in a straight line, the length L of the box main body becomes longer. Consequently, to make the box main body close to the center of the body, it is required to ensure a relatively large space on the central side of the body. However, in actual practice, it is difficult to ensure a relatively large space on the central side of the body, and thereby the box main body must be disposed on the outer side of the body.

As a result, the distance between the left and right side walls under the seat 17 cannot be reduced in size, so that a driver cannot sit astride the seat 17 with a natural posture.

In addition, the air box 40 includes, at its portion in front of the fourth intake pipe 38, the swelled cover 46 swelled inwardly of the body 11 in the width direction. (See FIG. 2.) Accordingly, since the swelled cover 46 can be disposed in a space 79 in front of the engine 18, even if the swelled cover 46 is swelled inwardly of the body 11 in the width direction, that is, swelled to the engine 18 side, the swelled cover 46 does not interfere with the engine 18.

As a result, since the swelled cover 46 can be disposed in such a manner as to be close to the center 10*a* (see FIG. 2) side of the personal watercraft 10, the distance S between the left and right side walls 30 and 32 extending downwardly from the seat 17 can be reduced in size, to allow a driver to sit astride the seat 17 with a natural posture.

A throttle valve 88 (see FIG. 9) is disposed in the vicinity of an inner wall of the air box 40. A leading end 80*a* of a throttle cable 80 is connected to the throttle valve 88, and a base end of the throttle cable 80 is connected to a throttle lever 81 (see FIG. 9) of the steering handlebar 16.

Figure 9:
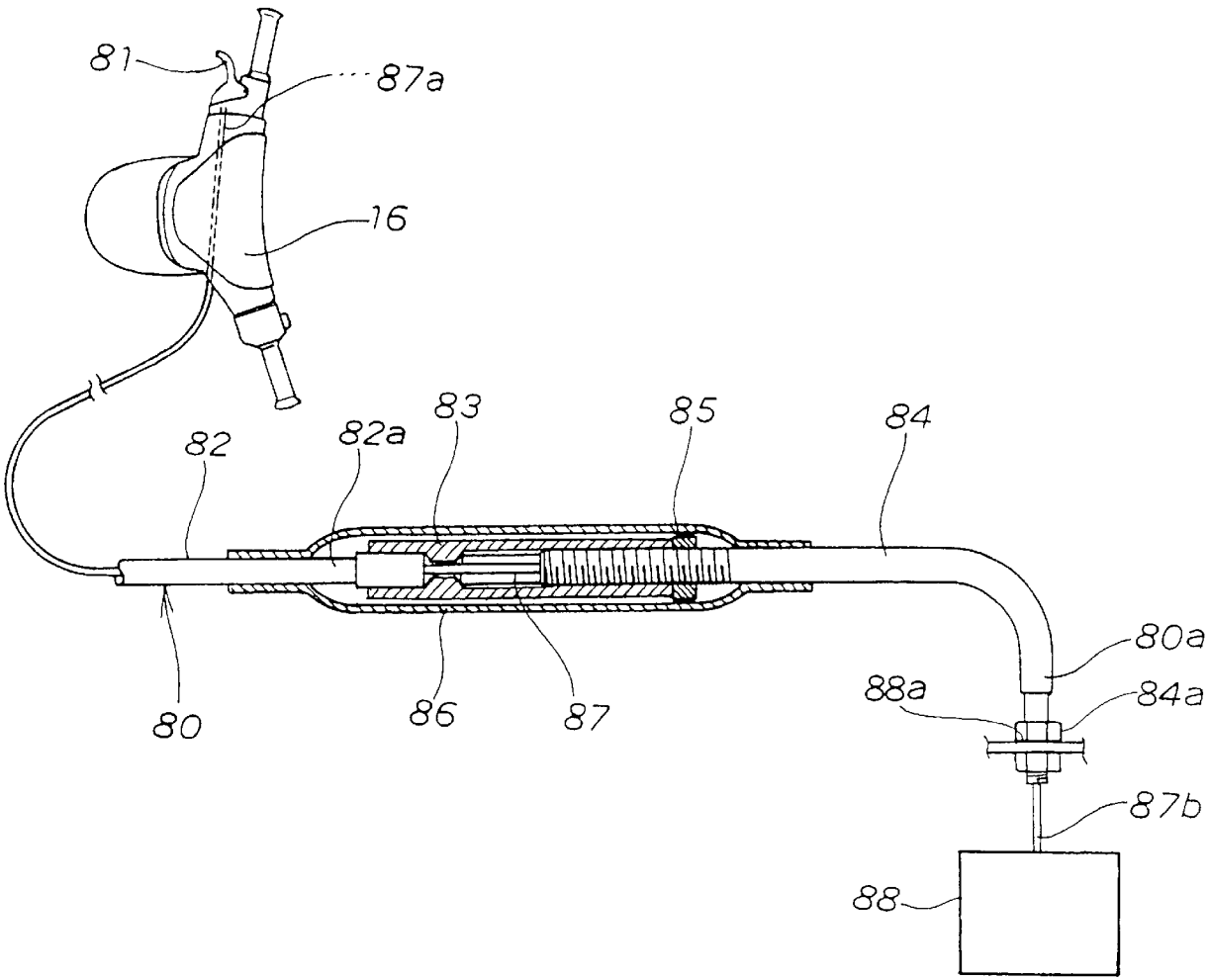
FIG. 9 is a sectional view showing a throttle cable of the personal watercraft according to the present invention.

FIG. 9 is a sectional view showing the throttle cable used for the personal watercraft according to the present invention.

The throttle cable 80 is configured as follows. A connecting device 84 is connected to a leading end 82*a* of an outer case 82 via an adjustment nut 83. The adjustment nut 83 is locked with a lock nut 85. The lock nut 85 and the adjustment nut 83 are covered with a boot 86. An inner cable 87 is slidably mounted to the adjustment nut 83 and the connecting device 84. A base end 87*a* of the inner cable 87 is connected to the throttle lever 81 of the steering handlebar 16, and a leading end 87*b* is connected to a lever (not shown) of the throttle valve 88.

A connecting portion 84*a* of the connecting device 84 can be adjusted to a mounting position 88*a* of the throttle valve 88 by loosening the lock nut 85 and turning the adjustment nut 83. By disposing the adjustment nut 83 over the engine 18 as shown in FIG. 8, the adjustment nut 83 can be simply operated from above the engine 18.

Since the throttle lever 81 is connected to the lever of the throttle valve 88 by means of the throttle cable 80, an amount of an air-fuel mixture to be supplied to each of the cylinders can be adjusted by operating the inner cable 87 with the throttle lever 81, thereby controlling the lever of the throttle valve 88.

The function of the personal watercraft will be described with reference to FIGS. 10 to 12.

Figure 10:
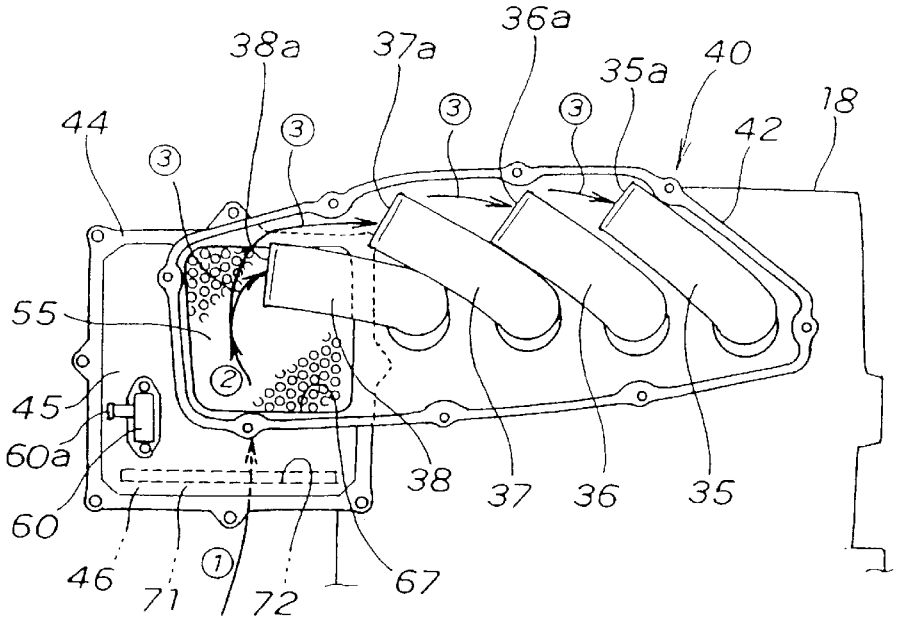
FIG. 10 is a view showing a first function of the personal watercraft according to the present invention.

FIG. 10 is a view illustrating a first function of the personal watercraft according to the present invention, showing a state wherein air is sucked in.

Air is sucked from the air suction port 72 formed in the lower portion 71 of the swelled cover 46 into the swelled portion 44 as shown by an arrow (1). The air sucked into the swelled portion 44 is directed to the air inlet 67 via the intake trap 55, and is then directed into the box main body 42 through the air inlet 67 as shown by an arrow (2).

Since the air directed into the swelled portion 44 passes through the intake trap 55, dust contained in the air can be removed by the intake trap 55. As a result, the air in the filtered state, that is, the clean air can be led into the box main body 42.

The air directed into the box main body 42 is directed in the first to fourth intake pipes 35 to 38 via the inlets 35*c* to 38*c* thereof, and is then directed in respective cylinders 18*a* . . . (see FIG. 1) from the first to fourth intake pipes 35 to 38.

In this case, since the breather trap 61 (see FIG. 5) is provided on the supporting frame 45 of the swelled portion 44, the breather pipe extending from the engine can be opened in the swelled portion 44 via the pipe 60*a* of the breather 60.

Figure 11:
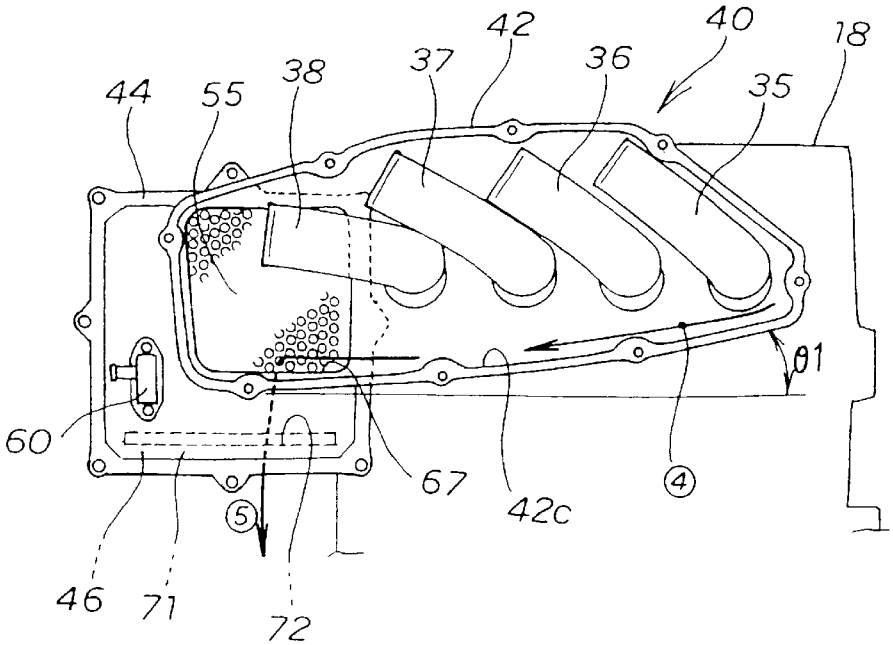
FIG. 11 is a view showing a second function of the personal watercraft according to the present invention.

FIG. 11 is a view illustrating a second function of the personal watercraft according to the present invention, showing a state wherein sea water or other water having penetrated in the air box is removed.

The personal watercraft 10 shown in FIG. 1 may be sometimes turned over during operation thereof, and if the personal watercraft 10 is turned over, sea water or other water may penetrate into the air box 40. If the personal watercraft 10 is restored to a normal position in such a state, the water may remain on the bottom surface 42*c* of the box main body 42 and the bottom surface 43*a* of the lid body 43. (See FIG. 7.)

According to this embodiment, however, since the bottom surface 42*c* of the box main body 42 and the bottom surface 43*a* of the lid body 43 are each tilted at the descending angle of the tilt angle θ1 toward the air inlet 67, the water having penetrated into the air box 40 can be efficiently directed to the air inlet 67 along the bottom surfaces 42*c* and 43*a* as shown by an arrow (4) and be certainly made to flow from the air inlet 67 into the swelled portion 44 as shown by an arrow (5). The water thus flowing into the swelled portion 44 can be certainly discharged from the air suction port 72.

As a result, it is possible to prevent sea water or other water from remaining in the air box 40 or the swelled portion 44.

In addition, since the bottom surface 42*c* of the box main body 42 and the bottom surface 43*a* of the lid body 43 are each also tilted inwardly of the body 11 at the descending gradient of the tile angle θ2 as shown in FIG. 6, the water having penetrated in the air box 40 can be more efficiently led to the air inlet 67, to flow in the swelled portion 44, and the water flowing into the swelled portion 44 can be more certainly discharged from the air suction port 72.

Figure 12:
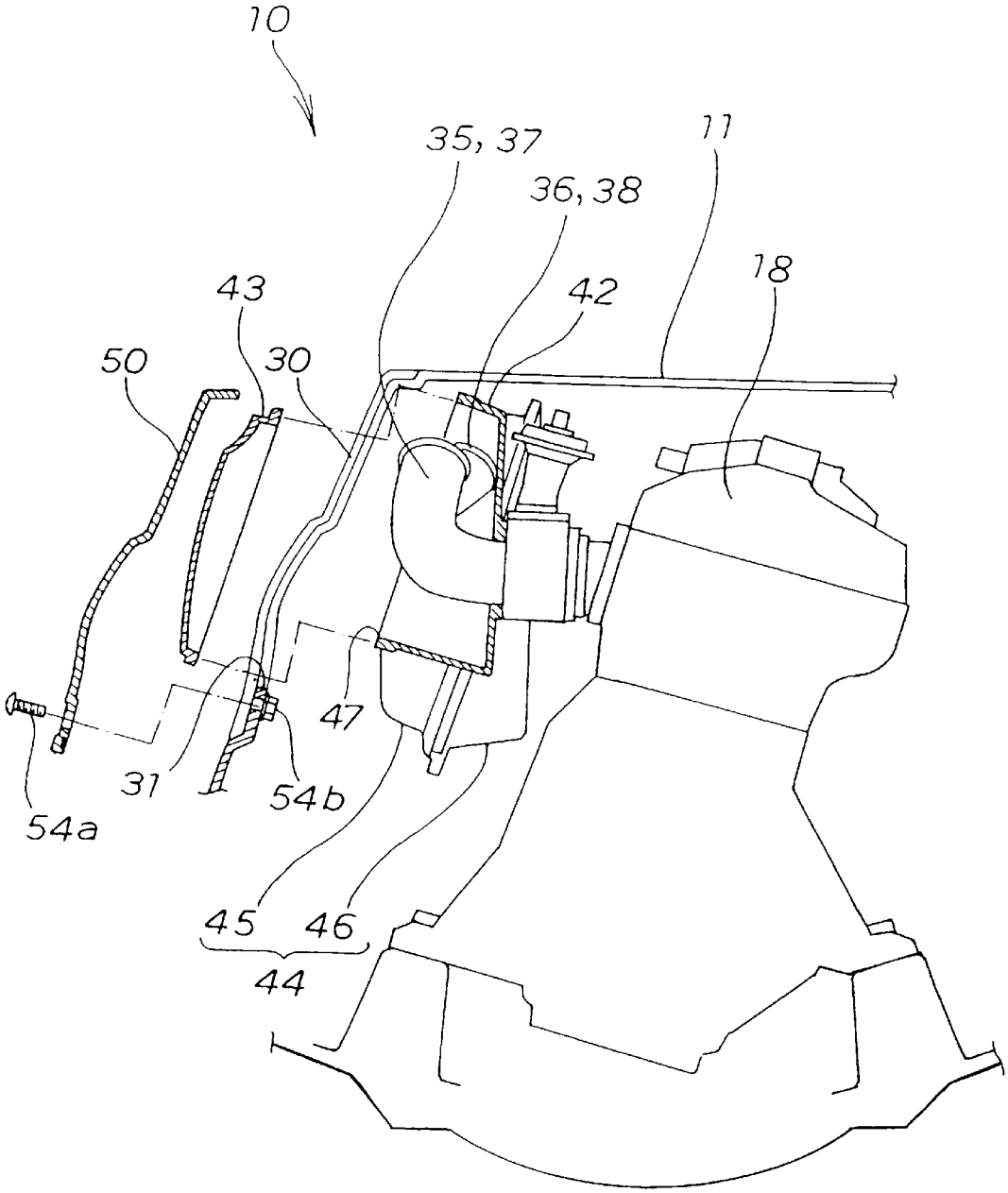
FIG. 12 is a view showing a third function of the personal watercraft according to the present invention.
Figure 13:
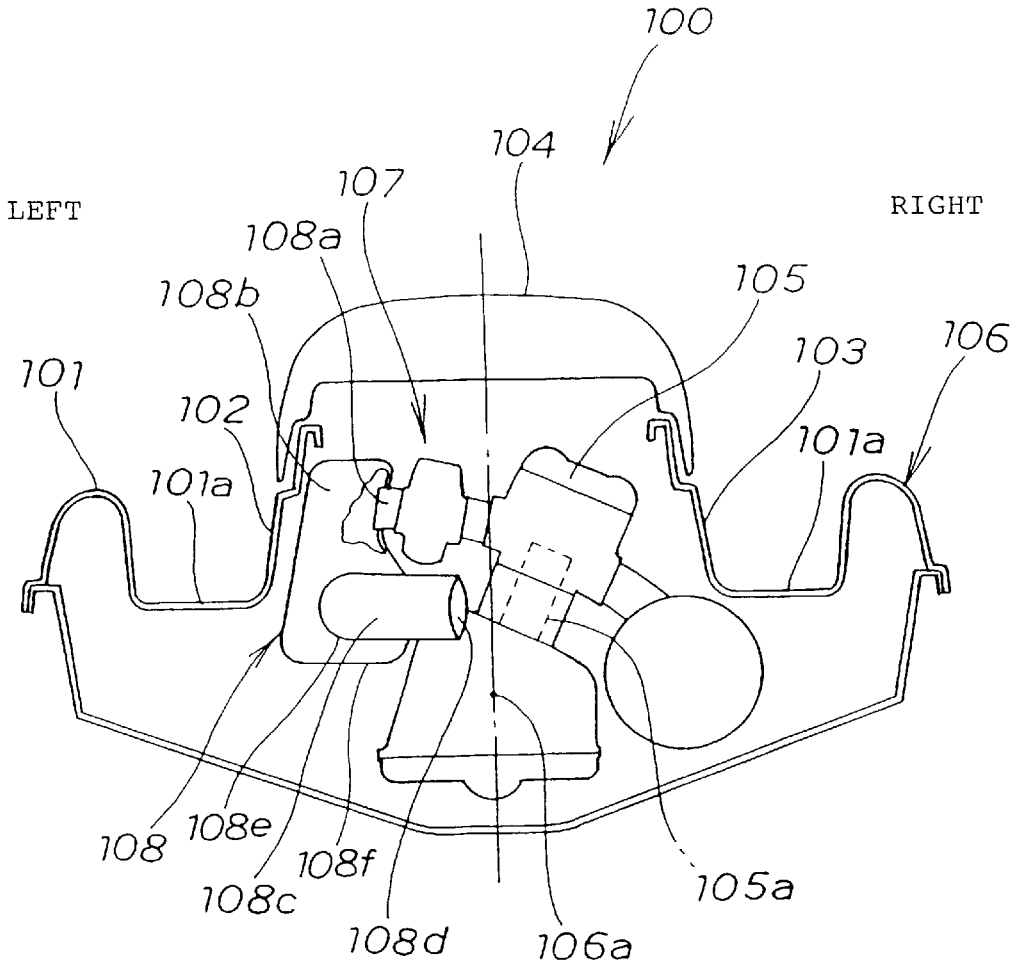
FIG. 13 BACKGROUND ART
FIG. 13 is a sectional view of a related art personal watercraft.

FIG. 12 is a view illustrating a third function of the personal watercraft according to the present invention, showing a state wherein the first to fourth intake pipes 35 to 38 in the air box 40 are subjected to maintenance and inspection.

The opening 31 is formed in the portion, opposed to the lid body 43, of the left side wall 30, and the side cover 50 is removably mounted to the opening 31. The opening 31 can be uncovered by removing the side cover 50 from the left side wall 30, for example, at the time of performing maintenance and inspection of the first to fourth intake pipes 35 to 38. As a result, the lid body 43 can be simply removed from the box main body 42 by making use of the uncovered opening 31.

Since the lid body 43 is disposed on the side surface of the air box 40, the shape of the lid body 43 can be increased in size. By simply removing the lid body 43 having such a large size, a large opening appears in the box main body 42. As a result, the maintenance and inspection of the first to fourth intake pipes 35 to 38 in the air box 40 can be simply performed via the large opening.

In addition, at the time of removing the lid body 43, the mounting face 47 of the box main body 42 is directed to the opening 31 of the left side wall 30, so that the maintenance and inspection of the first to fourth intake pipes 35 to 38 in the air box 40 can be more simply performed.

It is to be noted that the intake pipes are taken, in the above embodiment, as the four intake pipes, that is, the first to fourth intake pipes 35 to 38. However, the present invention can be applied to a personal watercraft provided with intake pipes of any other number.

The swelled portion 44 of the air box 40 is provided, in the above embodiment, at the front end portion 42*b* of the box main box 42. However, it may be provided at a rear end portion 42*a* of the box main body 42.

In the embodiment, description has been made by way of an example wherein the personal watercraft 10 is taken as the jet propulsion watercraft propelled by the jet propulsion unit. However, the propelling means of the personal watercraft is not limited thereto.

The present invention configured as described above exhibits the following effects:

According to the present invention, the air suction port is formed in the lower portion of the swelled portion of the air box. Accordingly, if sea water or other water penetrates into the air box, the water can be directed to the air suction port and be discharged outwardly from the air suction port. As a result, it is possible to prevent sea water or other water from remaining in the air box.

The air box has, at its portion in front of or behind the intake pipes, the swelled portion. In other words, the swelled portion can be disposed in front of or behind the engine. Accordingly, even if the swelled portion is swelled inwardly of the body in the width direction, it does not interfere with the engine. As a result, an outer side surface of the swelled portion can be made as close to the center side of the body as possible, so that the distance between the left and right side walls extending downwardly from the seat can be reduced in size.

This is advantageous in that when a driver sits astride the saddle-type seat with his or her feet resting on foot-rest portions on a deck, he or her can maintain a natural posture.

According to the present invention, the bottom surface of the air box is tilted at a descending gradient towards the air suction port. As a result, if sea water or other water penetrates into the air box, the water can be efficiently directed along the descending gradient toward the air suction port and be certainly discharged from the air suction port. This makes it possible to prevent sea water or other water from remaining in the air box.

According to the present invention, the intake trap is provided between the intake pipes and the air suction port. Accordingly, even if dust is contained in air sucked from the air suction port, the dust can be removed by the intake trap. As a result, it is possible to supply clean air having been filtered by the intake trap via the intake pipes to the cylinders and hence to desirably drive the engine.

If a flame flows in the swelled portion side by a phenomenon such as back fire, the flow of the flame can be blocked by the intake trap, and the flame can be prevented from emerging from the swelled portion.

According to the present invention, the breather pipe is provided in the swelled portion via the breather trap. Accordingly, if flame flows in the swelled portion side by a phenomenon such as back fire, the flow of the flame can be blocked by the breather trap.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft, in which a saddle-type seat is disposed at approximately a central portion of a body, an engine is mounted under said seat with an axial line of a crankshaft of said engine extending in the longitudinal direction of said body, a plurality of cylinders provided in said engine extend along the longitudinal direction of said body, respective intake pipes communicate to said cylinders and extend from a side surface of said engine, and an air box for containing said intake pipes is disposed in a space between said engine and a side wall, said personal watercraft comprising:

a swelled portion swelled inwardly of said body in the width direction, said swelled portion being formed in said air box at a portion in front of said intake pipes; and an air suction port is formed in a lower portion of said swelled portion.

2. The personal watercraft according to claim 1, wherein a bottom surface of said air box is tilted at a descending gradient towards said air suction port.

3. The personal watercraft according to claim 1, wherein an intake trap is disposed in said swelled portion at a position between said intake pipes and said air suction port.

4. The personal watercraft according to claim 1, wherein a breather pipe is mounted to said swelled portion via a breather trap.

5. The personal watercraft according to claim 1, wherein the swelled portion is a substantially rectangular member for positioning a filter member for filtering air prior to being supplied to the respective intake pipes.

6. The personal watercraft according to claim 1, wherein a plurality of intake pipes are disposed in the air box, said plurality of intake pipes being positioned at a predetermined angle for permitting air to be supplied thereto while preventing water from flowing into said plurality of intake pipes.

7. A personal watercraft, in which a saddle-type seat is disposed at approximately a central portion of a body, an engine is mounted under said seat with an axial line of a crankshaft of said engine extending in the longitudinal direction of said body, a plurality of cylinders provided in said engine extend along the longitudinal direction of said body, respective intake pipes communicate to said cylinders and extend from a side surface of said engine, and an air box for containing said intake pipes is disposed in a space between said engine and a side wall, said personal watercraft comprising:

a swelled portion swelled inwardly of said body in the width direction, said swelled portion being formed in said air box at a portion behind said intake pipes; and an air suction port is formed in a lower portion of said swelled portion.

8. The personal watercraft according to claim 7, wherein a bottom surface of said air box is tilted at a descending gradient towards said air suction port.

9. The personal watercraft according to claim 7, wherein an intake trap is disposed in said swelled portion at a position between said intake pipes and said air suction port.

10. The personal watercraft according to claim 7, wherein a breather pipe is mounted to said swelled portion via a breather trap.

11. The personal watercraft according to claim 7, wherein the swelled portion is a substantially rectangular member for positioning a filter member for filtering air prior to being supplied to the respective intake pipes.

12. The personal watercraft according to claim 7, wherein a plurality of intake pipes are disposed in the air box, said plurality of intake pipes being positioned at a predetermined angle for permitting air to be supplied thereto while preventing water from flowing into said plurality of intake pipes.

13. An air box for use with a personal watercraft having a saddle-type seat disposed at approximately a central portion of a body with an engine is mounted under the seat and a plurality of cylinders provided in the engine extending in a longitudinal direction of said body with respective intake pipes communicating to the cylinders and extending from a side surface of the engine comprising:

an air box for containing said intake pipes, said air box being disposed in a space between the engine and a side wall;

a swelled portion swelled inwardly of said body in the width direction, said swelled portion being formed in a portion of said air box; and an air suction port formed in a lower portion of said swelled portion.

14. The air box according to claim 13, wherein a bottom surface of said air box is tilted at a descending gradient towards said air suction port.

15. The air box according to claim 13, wherein an intake trap is disposed in said swelled portion at a position between said intake pipes and said air suction port.

16. The air box according to claim 13, wherein a breather pipe is mounted to said swelled portion via a breather trap.

17. The air box according to claim 13, wherein the swelled portion is a substantially rectangular member for positioning a filter member for filtering air prior to being supplied to the respective intake pipes.

18. The air box according to claim 13, wherein a plurality of intake pipes are disposed in the air box, said plurality of intake pipes being positioned at a predetermined angle for permitting air to be supplied thereto while preventing water from flowing into said plurality of intake pipes.

* * * * *